US006269967B1

(12) United States Patent
de Vries

(10) Patent No.: US 6,269,967 B1
(45) Date of Patent: Aug. 7, 2001

(54) RECTANGULAR CONTAINER WITH COVER

(75) Inventor: Jef de Vries, Blitterswijck (NL)

(73) Assignee: Wavin Trepak, B.V., Hardenberg (NL)

( * ) Notice: Subject to any disclaimer, the term of this patent is extended or adjusted under 35 U.S.C. 154(b) by 0 days.

(21) Appl. No.: 08/976,599

(22) Filed: Nov. 24, 1997

Related U.S. Application Data

(63) Continuation of application No. PCT/NL96/00204, filed on May 17, 1996.

(30) Foreign Application Priority Data

May 23, 1995 (NL) ..... 1000422

(51) Int. Cl.[7] ..... B65D 6/08; B65D 45/16
(52) U.S. Cl. ..... 220/669; 206/519; 220/324
(58) Field of Search ..... 229/116.1, 120.19, 229/120.21; 220/675, 669, 677, DIG. 14, 771, 324, 670; 206/518, 519

(56) References Cited

U.S. PATENT DOCUMENTS

| | | | | |
|---|---|---|---|---|
| 1,935,848 | * | 11/1933 | Kielberg | 220/619 |
| 2,606,586 | * | 8/1952 | Hill | 206/518 X |
| 3,268,144 | * | 8/1966 | Gaunt | 220/669 X |
| 3,384,265 | | 5/1968 | Frank . | |
| 3,448,775 | * | 6/1969 | Limbach et al. | 220/669 X |
| 3,759,415 | | 9/1973 | Cloyd . | |
| 3,780,899 | * | 12/1973 | Roper | 220/669 X |
| 3,817,419 | | 6/1974 | Moller et al. . | |
| 4,058,247 | * | 11/1977 | Florian | 220/DIG. 14 X |
| 4,531,652 | * | 7/1985 | Hara | 220/669 |
| 4,859,822 | * | 8/1989 | Ragusa et al. | 206/518 X |
| 5,224,623 | * | 7/1993 | LaFleur | 220/669 |
| 5,423,453 | * | 6/1995 | Fritz | 220/675 X |
| 5,577,613 | * | 11/1996 | Laidlaw | 220/4.27 X |
| 5,641,065 | * | 6/1997 | Owens et al. | 220/324 X |
| 5,671,857 | * | 9/1997 | Stromberg | 220/771 X |
| 5,676,276 | * | 10/1997 | Zielinski et al. | 220/669 X |
| 5,904,269 | * | 5/1999 | Wolf | 220/756 |

FOREIGN PATENT DOCUMENTS

| | | | | |
|---|---|---|---|---|
| 86 16 489 | | 9/1986 | (DE) . | |
| 38 02 287 | | 4/1989 | (DE) . | |
| 89 03 754 | | 6/1989 | (DE) . | |
| 0 011 726 | | 6/1980 | (EP) . | |
| 0 579 225 | | 1/1994 | (EP) . | |
| 609141 | * | 9/1948 | (GB) | 206/518 |
| 948898 | | 2/1964 | (GB) . | |
| 2 268 734 | | 1/1994 | (GB) . | |
| 102741 | * | 10/1941 | (SE) | 220/677 |
| WO 94/10053 | | 5/1995 | (WO) . | |

* cited by examiner

*Primary Examiner*—Allan N. Shoap
*Assistant Examiner*—Joe Merek
(74) *Attorney, Agent, or Firm*—Blank Rome Comisky & McCauley LLP

(57) ABSTRACT

A plastic container of an essentially rectangular shape comprises a bottom, upright side walls connecting to the bottom and having essentially equal thicknesses, and an outward beaded top edge on which the edge of a cover which closes the container can be fixed. Each upright side wall is divided in the vertical direction of the container into two interconnecting side wall parts, the lower side wall part being made curved towards the inside of the container (concave), and the upper side wall part being made curved towards the outside of the container (convex), and the upper and lower side wall parts being connected to each other by an intermediate part. This produces a very stable container, which is suitable for storage and transportation of sensitive powdered materials.

9 Claims, 7 Drawing Sheets

RECTANGULAR CONTAINER WITH COVER

This is a continuation of co-pending application Ser. No. PCT/NL96/00204 filed May 17, 1996.

The invention relates to a plastic container of an essentially rectangular shape, comprising a bottom, upright side walls connecting to the bottom and having essentially equal wall thicknesses and an outward beaded top edge on which the edge of a cover which closes the container can be fixed.

Such a container is known in many embodiments and is used, closed by a cover, for the storage and transportation of products of all kinds. In general, the walls and the bottom of the container are relatively thin, in order to keep the weight of the container low. However, the disadvantage of this is that the stability and sturdiness of the container, particularly when it is a large container, leave something to be desired.

This is a disadvantage in particular if the container is intended for the storage and/or transportation of powdered materials, such as tetrafluoroethylen powder, which are sensitive to compressive stresses as the result of, for example, shocks and vibrations. Such powdered materials, which have to be processed in, for example, a fluidized state, can go lumpy under the influence of even slight compressive stresses, and thereby become unusable. Said materials are generally also sensitive to moisture. Until now, said materials have therefore been stored and/or transported in round containers or drums, which are stable per se and can be closed well with a cover (see U.S. Pat. No. 4,674,650). However, when round containers are used, a large amount of wasteful space occurs between containers which are placed next to each other.

The object of the invention is to provide a container of the type mentioned at the beginning, which has sufficient stability and sturdiness and is suitable for the storage and/or transportation of sensitive powdered materials.

This object is achieved according to the invention through the fact that each upright side wall is divided in he vertical direction of the container into two interconnecting side wall parts, the lower side wall part being made curved towards the inside of the container (concave) and the upper side wall part being made curved towards the outside of the container (convex), and the upper and the lower side wall part being connected to each other by an intermediate part.

The special shape of the vertical side walls produces a very stable container. In fact, the upper and the lower side wall part have the tendency to buckle in different directions when under stress. However, since the two side wall parts are interconnected, the side wall in question will not buckle in either of the two directions.

The invention also relates to a cover for a container according to the invention, which cover has a peripheral edge which can grip over the beaded top edge of the container, and which cover is characterized in that at the rectangular sides it is provided with clamps which by way of hinges, preferably film hinges, are connected to the peripheral edge of the cover and can hook under the top edge of the container.

Due to the clamps, the cover according to the invention can be fixed easily and firmly on the container. The desired seal between the cover and the container can be obtained by a circumferential resilient lip which is known per se, and which is fitted in the peripheral edge of the cover and interacts with the top edge of the container.

Preferred embodiments of the container and the cover according to the invention are described in claims 2 to 5 and 6 to 8 respectively.

Finally, the invention relates to a combination of a container and a cover according to the invention.

The invention will be explained in greater detail with reference to the following exemplary embodiment shown in the drawing, in which.

Figure 1:
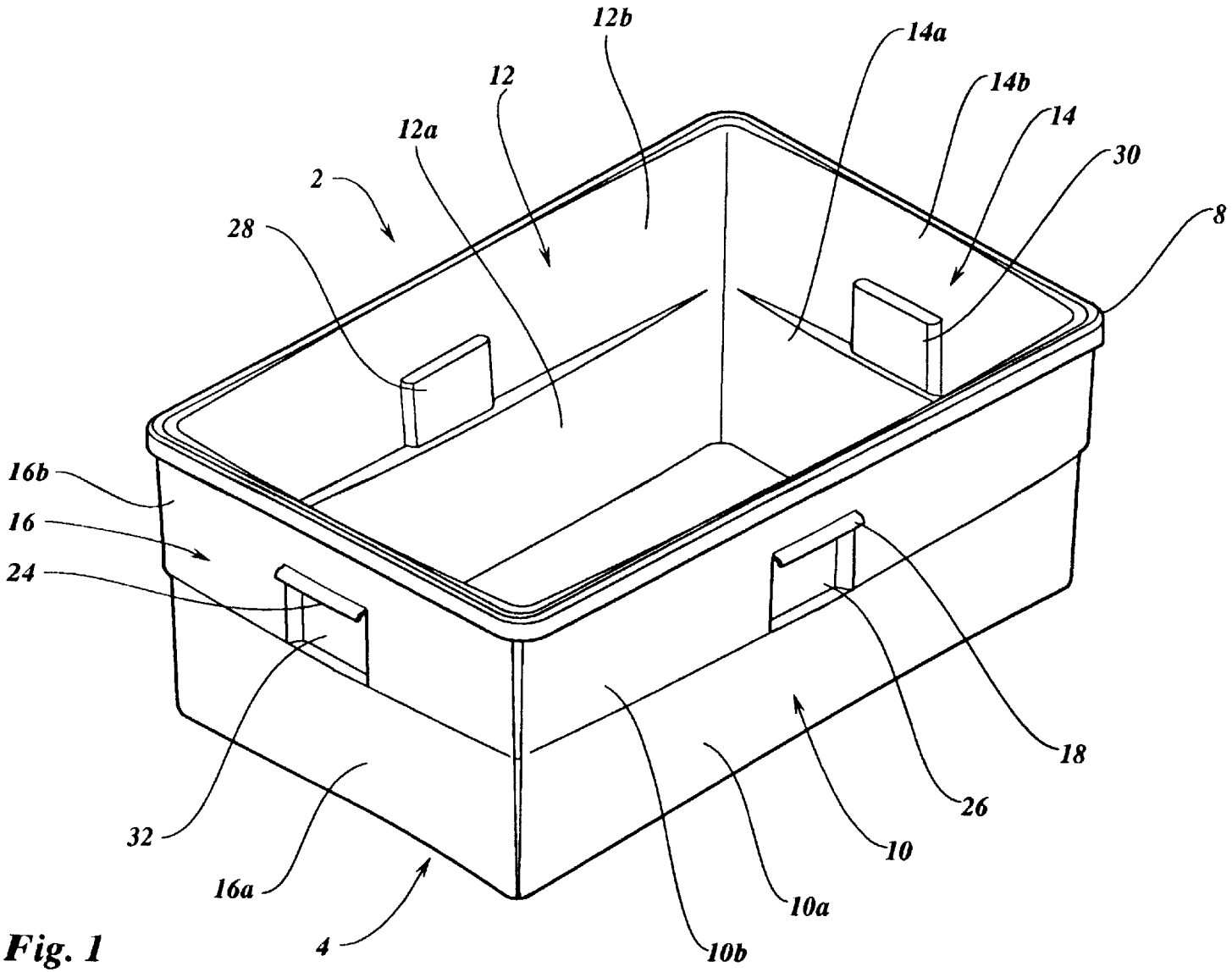
FIG. 1 shows diagrammatically and in perspective a container according to the invention.
Figure 2:
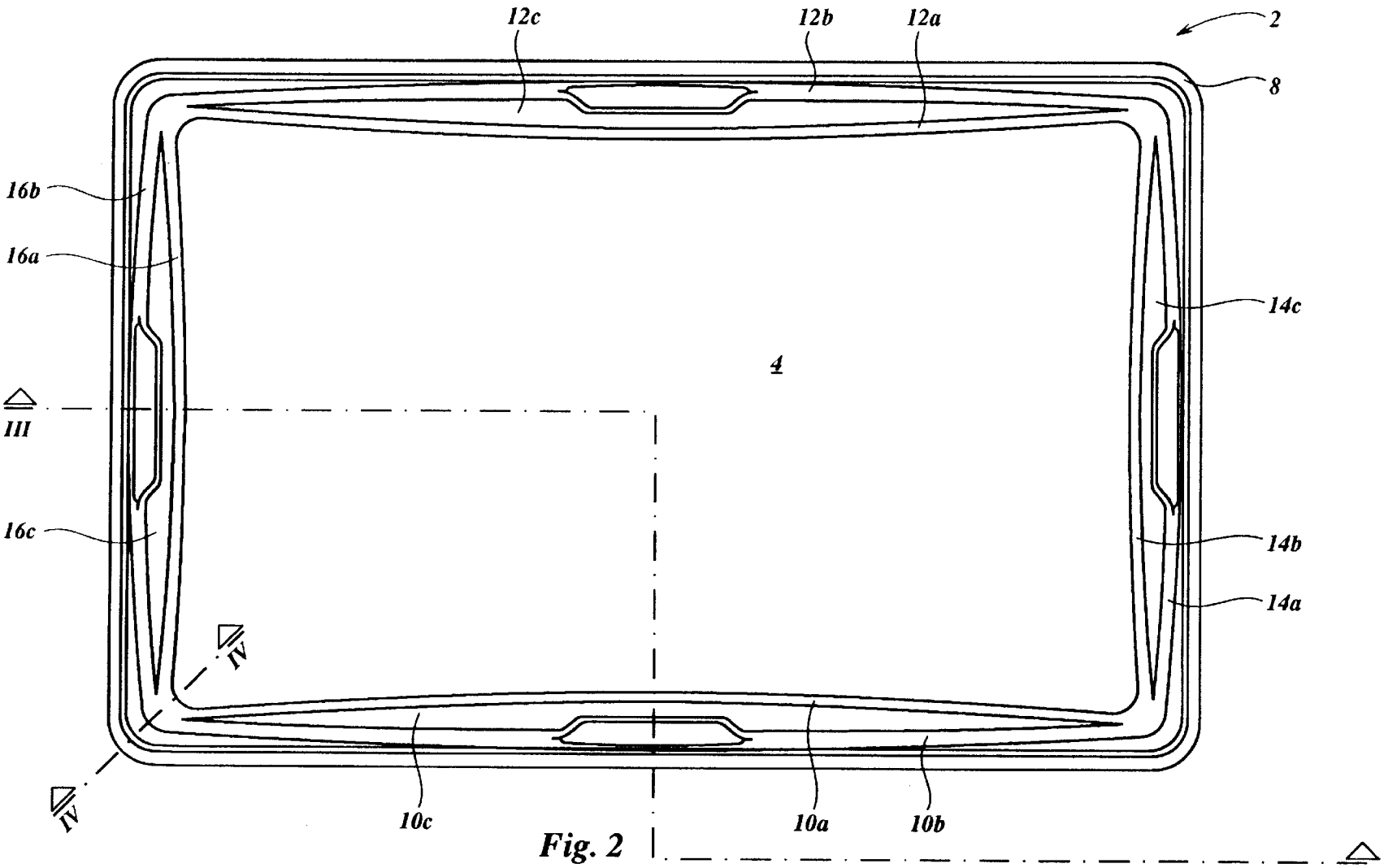
FIG. 2 is a top view on an enlarged scale of the container of FIG. 1.

FIGS. 1–4 show a container 2 according to the invention, to be provided with a cover. Said container, which is intended in particular for the storage and the transportation of sensitive powdered material, is essentially rectangular and comprises a bottom 4, side walls 10, 12, 14, 16 connecting to the bottom, and an outward beaded top edge 8. The edge of a cover (not shown in FIG. 1) can be fixed on the top edge 8.

In the vertical direction of the container, each upright side wall 10, 12, 14, 16 is divided into two interconnecting side wall parts 10*a*, 10*b*; 12*a*, 12*b*; 14*a*, 14*b* and 16*a*, 16*b* respectively. The lower side wall parts 10*a*, 12*a*, 14*a*, 16*a* are made curved towards the inside of the container (concave). The upper side wall parts 10*b*, 12*b*, 14*b*, 16*b* are made curved towards the outside of the container (convex). The upper and lower side wall parts are interconnected by means of an intermediate part 10*c*, 12*c*, 14*c* and 16*c* respectively.

Owing to this shape of the side walls, the container is very stable. The upper and lower side wall parts have the tendency under stress to buckle in opposite directions. However, due to the interconnection, they do not buckle in either direction.

The transition between the convex and concave side wall parts is preferably halfway up the container.

The side walls of the container merge into each other in the corners of the container by way of a curvature.

The top edge 8 of the container, which in cross-section is essentially the shape of an inverted U, and is consequently very stable, is straight on the outside in the region of the side walls. This means that containers can be placed close together. At the position of the corner regions of the container the top edge is rounded.

In the region of the upper side wall parts 10*b*, 12*b*, 14*b*, 16*b* the side walls 10, 12, 14, 16 are provided with a bearing edge 18, 20, 22, 24. These bearing edges extend only over a part of the length of the side wall part concerned, and are provided approximately in the centre thereof. The bearing edges fall within the outer periphery of the top edge 8. In the region 26, 28, 30, 32 situated below each bearing edge 18, 20, 22, 24 the upper side wall part 10*b*, 12*b*, 14*b*, 16*b* is recessed towards the inside of the container. A good handgrip is obtained in this way, with the result that the container is readily portable, while the side walls of the container are completely sealed. The position of the handgrips is such that there is as little rocking motion of the container as possible while a (filled) container is being carried.

Figure 3:
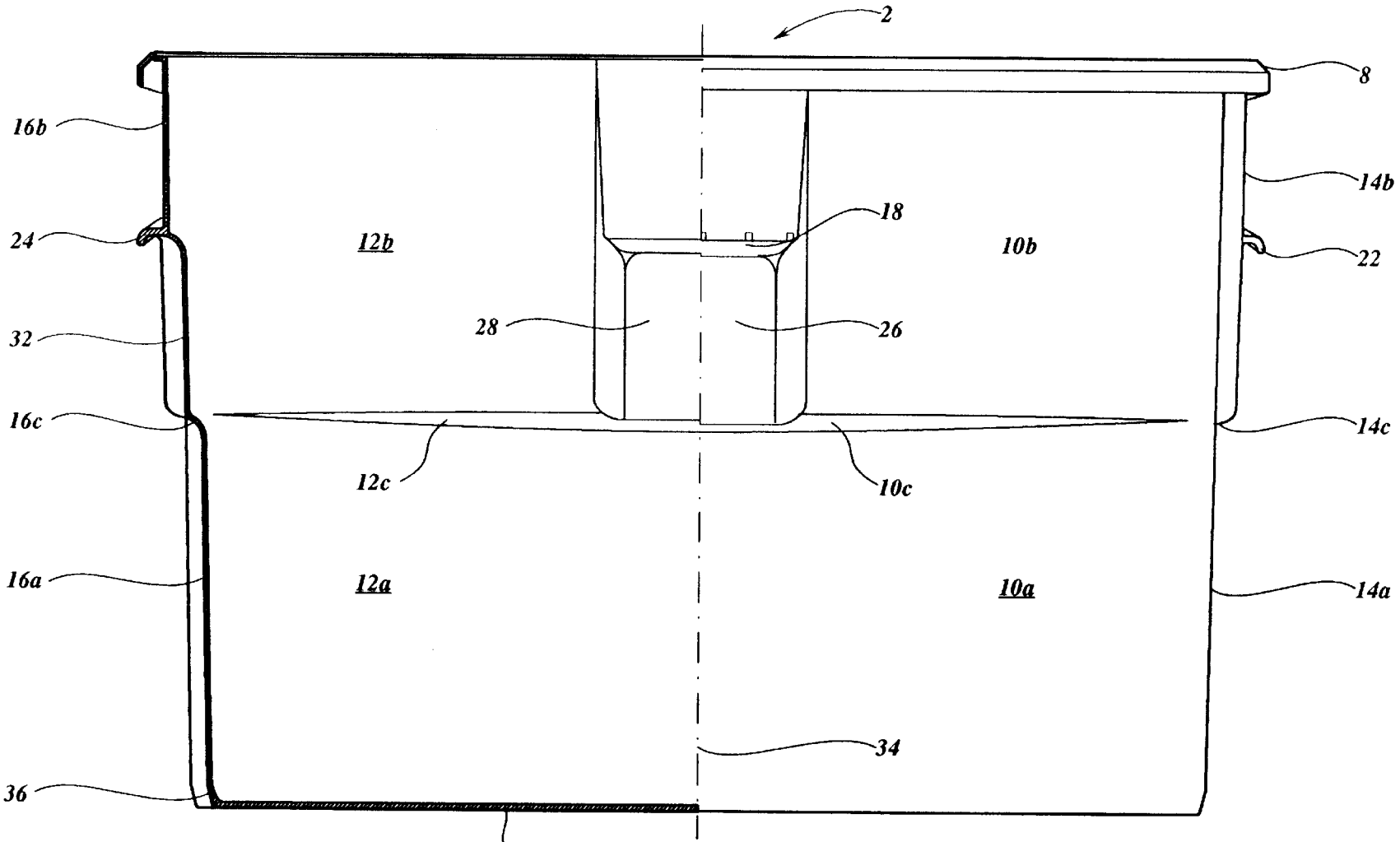
FIG. 3 is a view, partially in section, along the line III—III in FIG. 2.

As can be seen in FIG. 3, the side walls 10, 12, 14, 16 are at a slight angle relative to the axis 34 of the container at right angles to the bottom 4, as a result of which the dimensions of the container decrease from the top edge 8 towards the bottom 4. This makes the containers readily nestable on each other. During nesting of containers, the concave part of a container fits without any problem into the convex and the concave part of a container underneath, but the convex part does not fit into the concave part of a container underneath. During the nesting, the transition between the convex and concave side wall parts forms the boundary for the nesting. This means that containers placed in each other cannot become stuck in each other.

Figure 4:
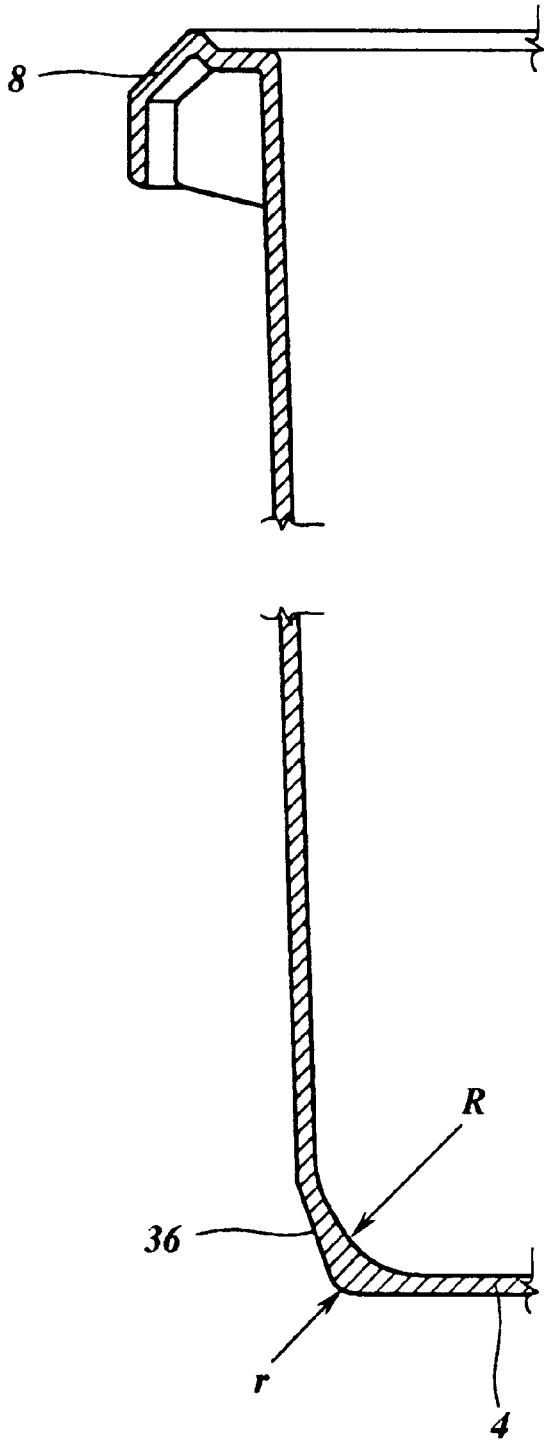
FIG. 4 is a vertical section on an enlarged scale along the line IV—IV in FIG. 2.

As can be seen in FIGS. 3 and 4, the container has a relatively large radius of curvature R on the inside in the transition regions between the side walls 10, 12, 14, 16 and the bottom 4. The external face 36 of the side walls in the abovementioned regions slants inwards towards the bottom 4 and passes with a relatively small radius of curvature r into the underside of the bottom 4. This means that inside the container a smooth transition is obtained between the side walls and the bottom of the container, thus avoiding sharp corners, in which dirt can accumulate or in which material residues can easily remain behind. This also prevents a very thick material edge from being produced in the transition regions between the side walls and the bottom of the container, which would be a disadvantage in the injection moulding process, while a sufficiently sturdy bottom edge remains, which keeps to a minimum the chance of deformation of the bottom edge in the event of a shock stress. Through the slanting external face 36 and the small radius of curvature r, the container is easily positioned in the lateral direction on, for example, a cover of a container underneath. The angle formed by the slanting external face 36 with the container axis 34 at right angles to the bottom 4 is greater than the angle formed by the side walls of the container with said axis 34, and is, for example, between 10° and 30°, and is expediently approximately 20°. The bottom 4 of the container can be reinforced in a known manner, for example by ribs provided on the underside.

Figure 5:
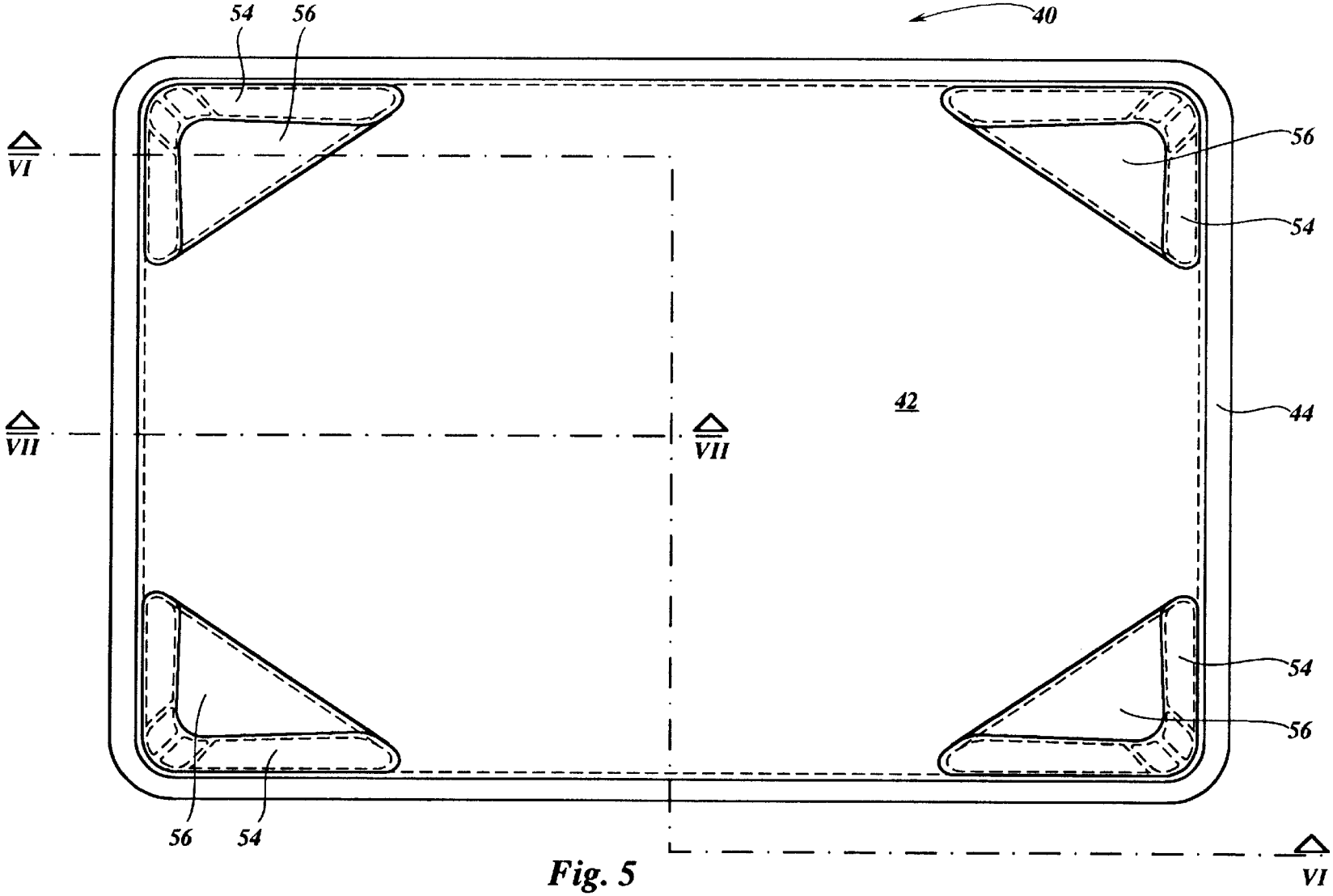
FIG. 5 is a top view of a cover according to the invention which fits on a container according to FIGS. 1–4.
Figure 6:
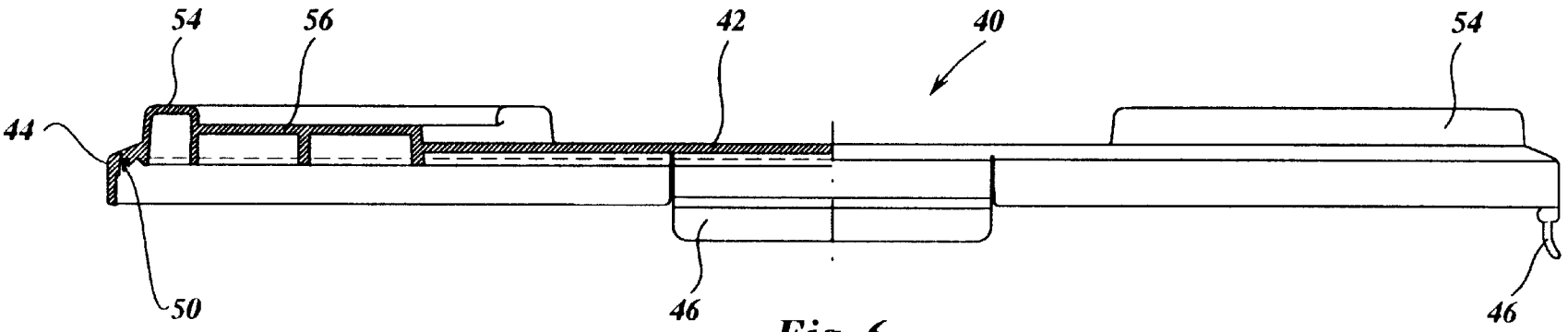
FIG. 6 is a view, partially in section, of the cover of FIG. 5, along the line VI—VI.
Figure 7:
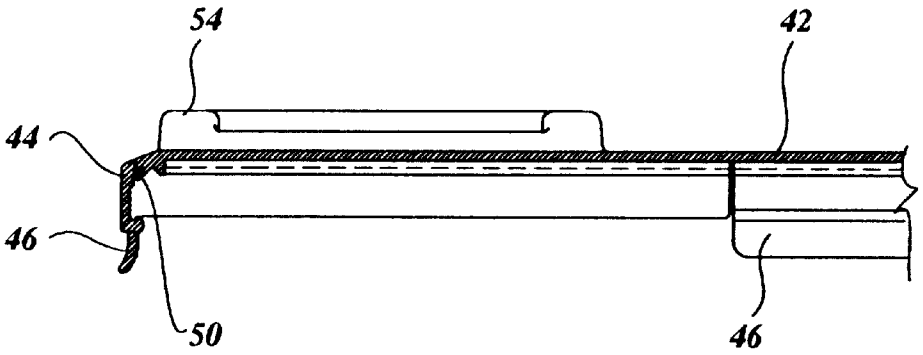
FIG. 7 is a view in section of the cover of FIG. 5, along the line VII—VII.

The cover 40 shown in FIGS. 5–7 for the container 2 shown in FIGS. 1–4 is essentially rectangular and has a cover face 42 and a peripheral edge 44 which can grip over the beaded top edge of the container 2.

Figure 8:
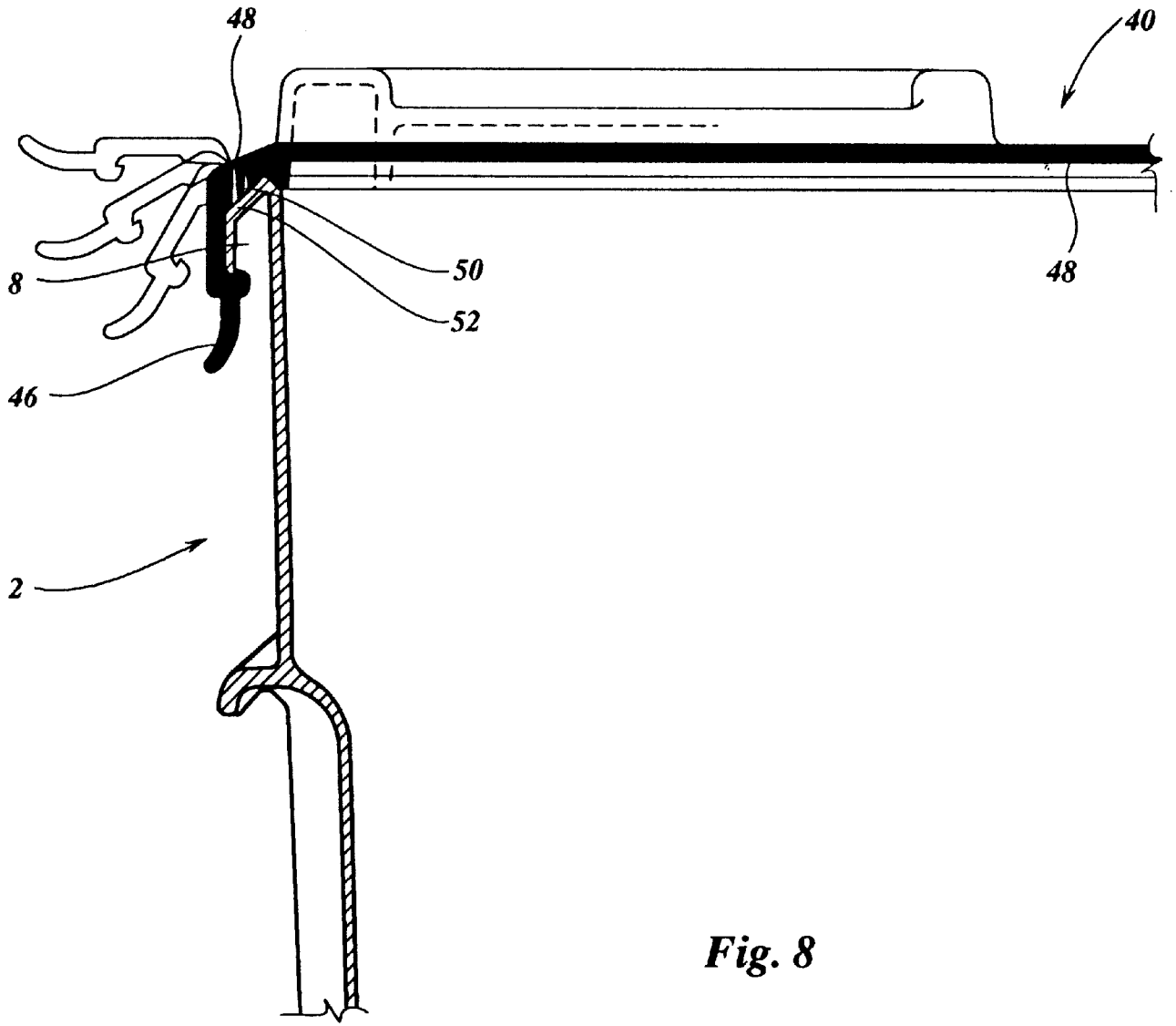
FIG. 8 shows on an enlarged scale the connection between the top edge of a container and a cover according to the invention.

The cover 40 is provided on the rectangular sides with clamps 46, which are connected by way of hinges, preferably film hinges 48, to the peripheral edge 44 of the cover, and which can hook under the top edge 8 of the container 2 (see FIG. 8). A cover 40 can be fixed firmly on a container 2 by means of these clamps 46. In order to obtain a good seal between the peripheral edge 44 of the cover 40 and the top edge 8 of the container 2, the peripheral edge 44 is provided on the inside with a circumferential resilient lip which rests on a slanting part 52 of the top edge 8 of the container 2 when the cover 40 is placed on the container 2 (see FIG. 8).

Near the corners, the cover 40 is provided with vertical lugs 54, fitted on the top side and extending in the corner regions along the peripheral edge 44 of the cover 40. The lugs are designed in such a way that a container 2 placed on top of the cover fits with its bottom 4 precisely between the lugs. This means that lateral shifting of the container on top relative to the container with cover underneath is prevented. Near the corners, the cover 40 is also provided with a raised part 56. Direct contact between the bottom of a container on top and the cover of a container underneath in a stack is prevented in this way. This gives optimum protection against settling of the contents of the container.

Between the raised parts 56, the cover face 42 is essentially flat, so that suction cups of a hoisting unit can be placed thereon. In this way a filled container provided with a cover can be lifted and moved without jolting. Moreover, a container can easily be lifted out of a group of containers standing next to each other.

The covers 40 are stackable on each other and, due to the presence of the lugs 54, stacked covers cannot shift relative to each other.

The following advantages are obtained with the containers and covers according to the invention:

- due to their shape, the containers are very stable, with the result that their contents are protected in the best possible way against external influences, and filled containers provided with covers can be stacked to great heights;
- due to the rectangular shape, little wasteful space occurs during storage and transportation, when several containers are placed next to and on top of each other;
- due to the presence of the bearing edges and the recessed wall parts lying underneath them, the containers are readily portable;
- the containers can be closed well by means of the accompanying covers;
- containers provided with covers can easily be lifted by means of suction cups;
- the containers are easy to manufacture by injection moulding, due to their shape;
- the containers are readily nestable and easy to separate from each other;
- the covers are stackable on each other in a stable manner.

What is claimed is:

1. Plastic container comprising a bottom, four interconnected upright sidewalls connecting to the bottom to form a substantially rectangular shape having four corners, said upright side walls terminating with an outward beaded top edge which interengages with the edge of a cover for closing the container, each upright side wall being divided in the vertical direction of the container into a lower side wall part and an upper side wall part, the upper and the lower side wall parts being connected to each other by an intermediate side wall part, said upper, lower, and intermediate side wall parts being below the beaded top edge, wherein the lower side wall part is curved towards the inside of the container between opposed corners of said side wall part, and the upper side wall part is curved towards the outside of the container between opposed corners of said side wall part, said curves beginning and ending immediately adjacent said corners, and wherein the intermediate side wall part forms a ledge which continuously bridges the upper and lower side walls.

2. Container according to claim 1, wherein the top edge of the container is straight on the outside of the container in the region of each side wall and is rounded in the corner regions of the container.

3. Container according to claim 1, wherein in the region of the upper side wall part at least two opposite side walls are provided with a lifting edge.

4. Container according to claim 3, wherein each lifting edge extends over a part of the length and approximately in the centre of the upper side wall part, and wherein in the region situated below the lifting edge the upper side wall part is recessed towards the inside of the container.

5. Container according to claim 1, provided with a cover having a peripheral edge which grips over the beaded top edge of the container, at the rectangular sides the cover being provided with clamps, which by way of hinges, are connected to the peripheral edge of the cover and which can hook under the top edge of the container.

6. Container according to claim 5, wherein near the corners, the cover is provided with vertical lugs, fitted on the top side and extending in the corners regions along the peripheral edge of the cover.

7. Container according to claim 5, wherein near the corners, the cover is provided with a raised part.

8. Container according to claim 5, wherein said hinges are film hinges.

9. Container according to claim 1, wherein said upright side walls comprise four walls, each wall connected to the next adjacent wall at a corner.

* * * * *